United States Patent [19]

Carpenter et al.

[11] Patent Number: 5,065,472

[45] Date of Patent: Nov. 19, 1991

[54] SPRING LOADED BRAKE ASSEMBLY FOR INDEXING SOOTBLOWER

[75] Inventors: Steven P. Carpenter; James C. Cavinee; James J. Krannitz, all of Lancaster, Ohio

[73] Assignee: The Babcock & Wilcox Co., New Orleans, La.

[21] Appl. No.: 645,220

[22] Filed: Jan. 24, 1991

[51] Int. Cl.[5] ..... F23J 3/02

[52] U.S. Cl. ..... 15/317; 122/390; 165/95

[58] Field of Search ..... 15/316.1, 317, 318, 15/318.1; 122/379, 390; 165/95

[56] References Cited

U.S. PATENT DOCUMENTS

| | | | |
|---|---|---|---|
| 3,604,050 | 9/1971 | Nelson et al. | 15/317 |
| 4,351,082 | 9/1982 | Ackerman et al. | 15/316.1 |
| 4,437,201 | 3/1984 | Zalewski | 15/316.1 |
| 4,803,959 | 2/1989 | Sherrick et al. | 122/379 |

*Primary Examiner*—Chris K. Moore

*Attorney, Agent, or Firm*—Harness, Dickey & Pierce

[57] ABSTRACT

A brake assembly for impeding the longitudinal travel of a moving object. The brake asembly provides for a biasing mechanism which biases an engagement block into the line of travel of the moving object. When the moving object contacts the block, movement is impeded until the object is subjected to a force capable of deflecting the block counter to the biasing member and out of the line of travel of the object. The object can thereafter move past the said brake assembly and continuing along its line of travel. In particular, the brake assembly is used to impede the longitudinal travel of a reciprocating sootblower until the cleaning nozzles of the sootblower have had their position indexed relative to a previous cleaning cycle.

12 Claims, 5 Drawing Sheets

SPRING LOADED BRAKE ASSEMBLY FOR INDEXING SOOTBLOWER

BACKGROUND AND SUMMARY OF THE INVENTION

This invention relates to a brake assembly particularly for a retracting sootblower for boiler cleaning having an indexing lance tube drive system.

Sootblowers are used to project a stream of blowing medium such as water, air or steam against heat transfer surfaces within large scale boilers to cause slag and ash encrustations to be removed. The blowing medium impact produces mechanical and thermal shock which causes these adhering layers to be removed. One general category of sootblowers is known as the long retracting type. These devices have a retractable lance tube which is periodically advanced into and withdrawn from the boiler and is simultaneously rotated such that one or more nozzles at the end of the lance tube project jets of blowing medium tracing helical paths.

Many conventional sootblowers, such as the so-called "IK" sootblower manufactured by Applicant, include a lost motion device which causes the nozzles to return along a helical path that bisects the helical path traced during forward travel. This indexing enables surfaces that were not cleaned during extension to be subjected to blowing medium upon retraction. Although the lance tube nozzles trace different helical paths upon extension and retraction, the positions of these helical paths are nonetheless fixed. Heat transfer surfaces continually subjected to impact by blowing medium suffer from erosion and wear. Furthermore, areas lying between the helical paths of the nozzle jets can sometimes escape adequate cleaning. In view of the foregoing, there is a need to provide a long retracting sootblower device having an indexing mechanism which provides a large number of different yet predictable helical paths traced by the lance tube nozzles.

U.S. Pat. No. 4,803,959, commonly assigned to the assignee of the present application, discloses a sootblower having an indexing drive system which slightly displaces the helical paths traced by the nozzles upon each sootblower actuation cycle, and thus overcomes the above mentioned disadvantages of prior art designs. The system according to the patent is particularly adapted for sootblowers having a lance tube driving carriage which is advanced and retracted while simultaneously rotating the lance tube. For many long retracting sootblower designs, the carriage has an electric drive motor which is coupled to a drive train having one or more pinion gears which mesh with elongated gear racks to cause the carriage and the lance tube to be retracted and advanced. The carriage also drives the lance tube for rotation through bevel gears.

The indexing system of the above patent provides for the displacement of the driving pinion gear along the longitudinal drive racks. The indexing system causes the pinion gear meshing with the rack to advance a predetermined number of gear teeth, with respect to the rack, upon each actuation cycle. Due to the geared connection between the lance tube's longitudinal and rotational drive systems, such drive pinion advancement causes a slight change in the position of the helical paths traced by the lance nozzles upon each actuation cycle. In other words, the position of the helical paths traced by the lance nozzles will be indexed a position or distance corresponding to the advancement of pinion. The indexing mechanism of the prior patent employs a movable rack segment which meshes with the main rack element and is caused to index by the tractive effort exerted by the pinion drive gear as the lance tube begins its cleaning cycle. In this manner, the indexing mechanism operates automatically and has been incorporated into new sootblowers as well as many existing sootblowers as a retrofit application.

Although the indexing mechanism of the above patent has been shown to operate well for numerous applications, it has some limitations when an attempt is made to apply it to certain new and retrofitting applications. As more fully described below, the application limitation results in cases where the carriage begins its initial forward movement without an adequate load being provided on the driving pinion shaft. Without the initial tractive effort, the pinion fails to index the movable rack segment and fails to be advanced relative to rack. Thus, the patent's indexing mechanism fails to be activated. In the present invention, a spring-loaded brake or friction key assembly is provided which will impede forward movement of the carriage until the load required to advance the pinion relative to the rack has been produced and the pinion has been advanced.

While the brake assembly was designed for incorporation with the indexing mechanisms of sootblowers, the invention of this application will also find utility wherever forward movement needs to be delayed until the development of a specific driving force.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
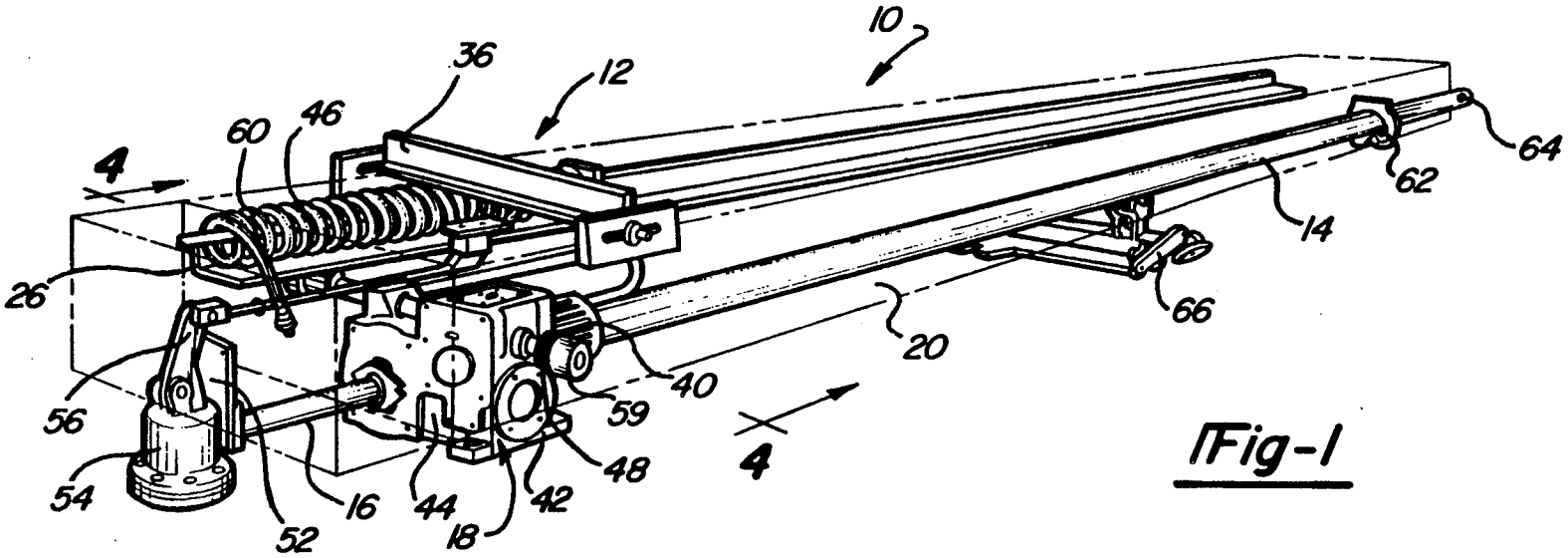
FIG. 1 is a pictorial view showing a long retracting sootblower incorporating the features of the present invention.

A sootblower including the improvements of the present invention is shown in FIG. 1 and is generally designated there by reference number 10. Sootblower 10 principally comprises frame assembly 12, lance tube 14, feed tube 16, and carriage 18. Sootblower 10 is shown in its normal resting position. Upon actuation, lance tube 14 is extended into and retracted from a boiler (not shown) and is simultaneously rotated.

Figure 4:
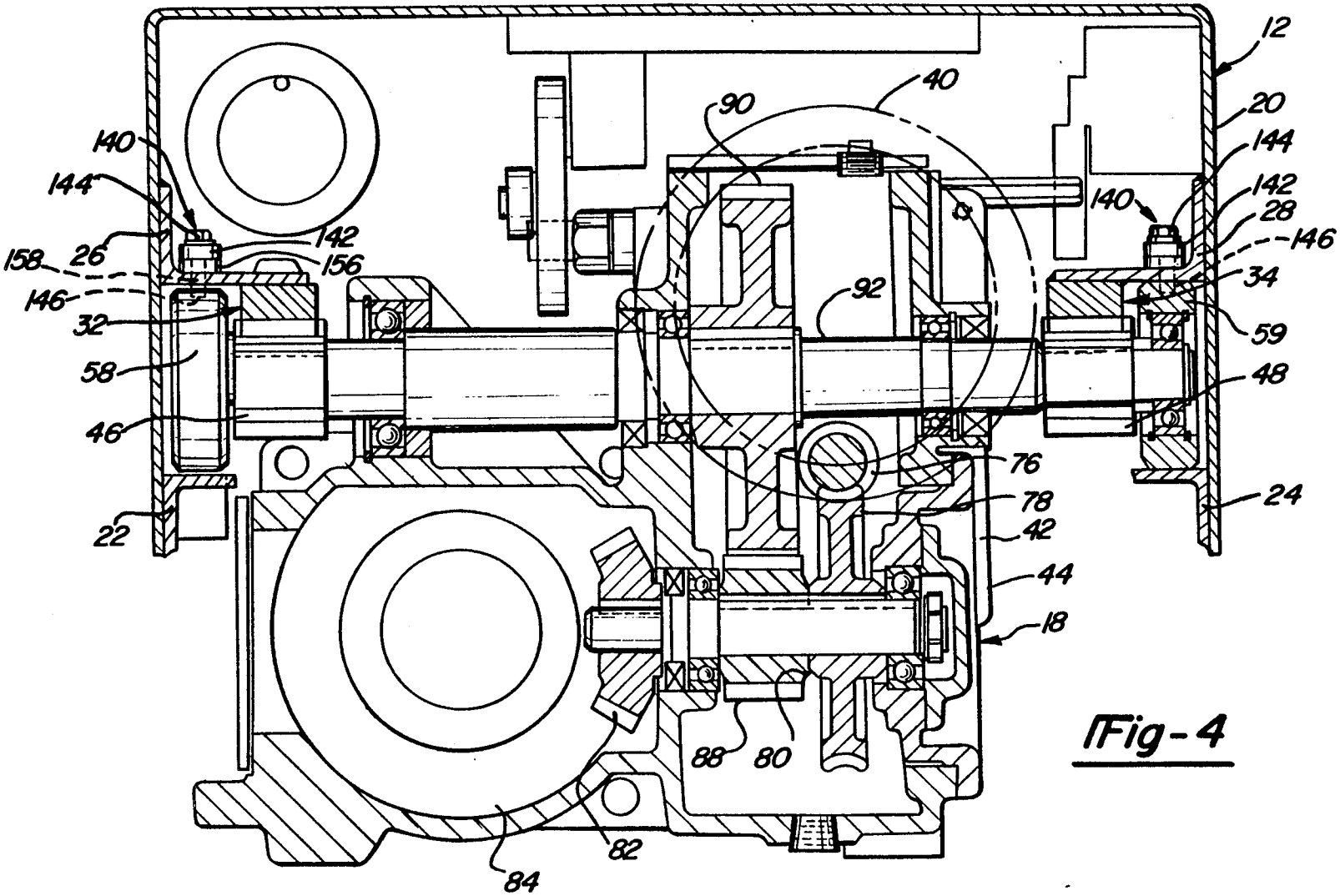
FIG. 4 is a cross-sectional view taken generally along lines 4—4 from FIG. 1 showing internal components of the carriage.

As best shown in FIG. 4, frame assembly 12 includes a generally rectangularly shaped frame box 20 which forms a housing for the entire unit. Carriage 18 is guided along two pairs of tracks located on opposite sides of frame box 20, including lower tracks 22 and 24, and upper tracks 26 and 28. Tracks 22 through 28 are made from angle iron stock which is connected to frame box 20 by threaded fasteners or welding. Toothed rack assemblies 32 and 34 are rigidly connected to upper tracks 26 and 28, respectively, and are provided to enable longitudinal movement of carriage 18. Frame assembly 12 is supported at a wall box (not shown) which is affixed to the boiler wall or another mounting structure, and is further supported by rear support bracket 36.

Carriage 18 drives lance tube 14 into and out of the boiler and includes drive motor 40 and gear box 42 which is enclosed by housing 44. Drive motor 40 drives a pair of pinion gears 46 and 48 which engage rack assemblies 32 and 34 to advance carriage 18 and lance tube 14. Support bearings or carriage rollers 58 and 59 engage with tracks 22 through 28 to support carriage 18.

Feed tube 16 is attached at one end to rear bracket 52 and conducts blowing medium which is controlled through the action of poppet valve 54. Poppet valve 54 is actuated through linkages 56 which are engaged by carriage 18 to begin blowing medium discharge upon extension of lance tube 14, and cuts off the flow once the lance tube and carriage return to their idle retracted position. Lance tube 14 overfits feed tube 16 and a fluid seal between them is provided by a packing gland (not shown) so that blowing medium is conducted into the lance tube for discharge from nozzles 64.

Coiled electrical cable 60 conducts power to drive motor 40 as it moves with carriage 18. Front support bracket 62 includes rollers and bearings which support lance tube 14 during its longitudinal and rotational motion. For long lance tube lengths, an intermediate support 66, also having rollers and bearings, may be provided to prevent excessive bending deflection of the lance tube. Additional details of the construction of a well-known design of an "IK" type sootblower is found in U.S. Pat. No. 3,439,376, issued to the assignee of this application which is hereby incorporated by reference.

Figure 3:
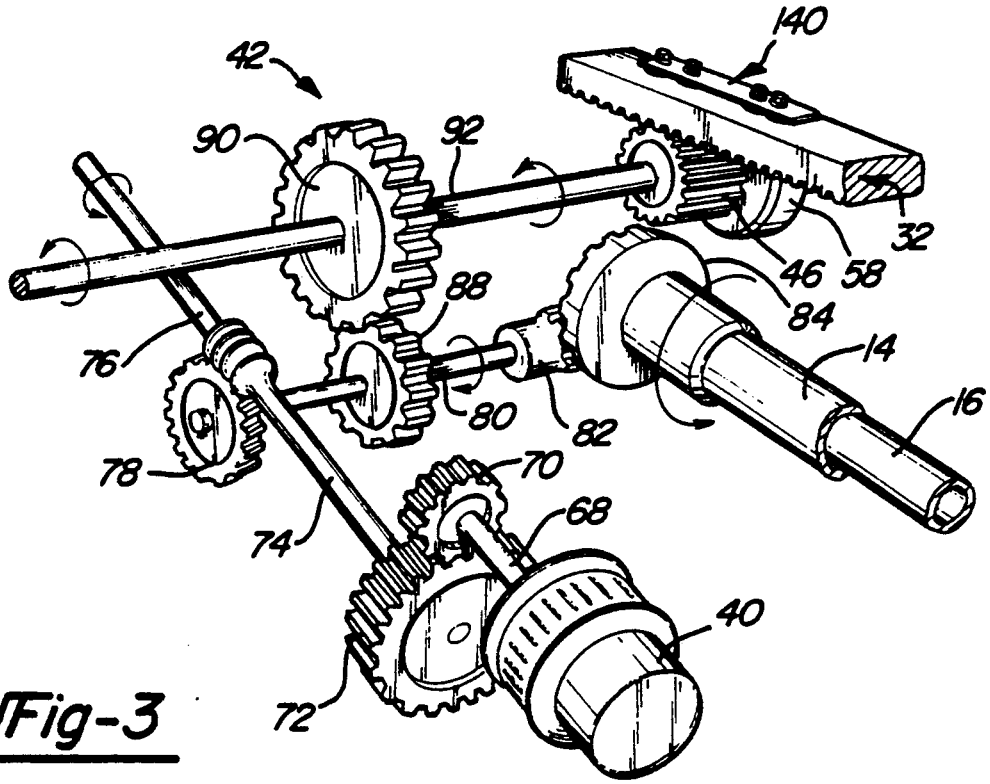
FIG. 3 is a simplified pictorial view showing the drive train arrangement of a sootblower carriage which causes extension and rotation of the lance tube of the sootblower shown in FIG. 1.

FIG. 3 provides a pictorial view of the drive train within gear box 42 of carriage 18. Drive motor 40 transmits power through output shaft 68, then through primary spur gears 70 and 72, and into primary output shaft 74. Primary output shaft worm gear 76 meshes with worm spur gear 78 causing rotation of shaft 80. Shaft 80 directly drives rotation bevel gear 82 which meshes with hub bevel gear 84, which is fixed to lance tube 14. Accordingly, bevel gears 82 and 84 impart rotational motion onto lance tube 14 in response to energization of motor 40. Shaft 80 also drives a pair of translation spur gears 88 and 90 which drive translation shaft 92. Pinion gears 46 and 48 (gear 48 not shown) are affixed to the opposite ends of shaft 92 and mesh with rack assemblies 32 and 34, as previously explained.

Figure 2:
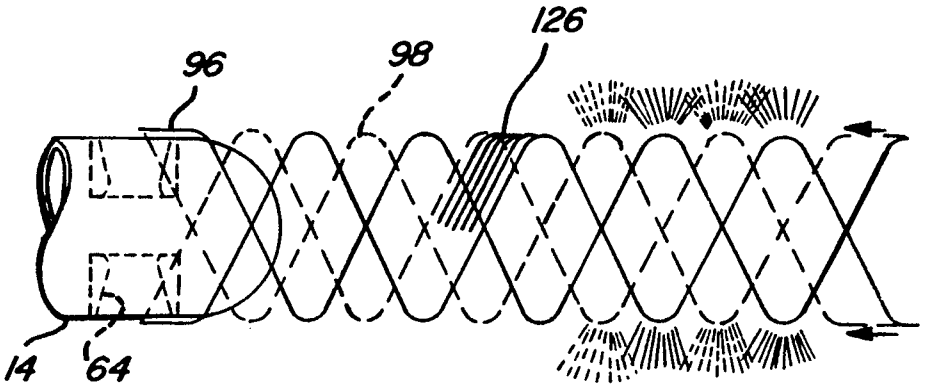
FIG. 2 is a pictorial side view showing the helical paths traced by the lance tube nozzles upon extension and retraction for the sootblower shown in FIG. 1.

As is evident from FIG. 3, due to the direct gear interconnections between the translation and rotational movements of lance tube 14, a fixed relationship in these motions is provided. FIG. 2 graphically illustrates the helical paths traced by a pair of diametrically opposed lance tube nozzles 64 during the extension and retraction movements of lance tube 14 for a conventional sootblower. Helical path 96 shown in full lines represents the paths traced by nozzles 64 during extension. For some designs of sootblowers 10, a lost motion device is positioned at hub 84 which introduces an indexing of the helical paths, such that upon retraction, the helix represented by phantom line 98 traces a path which lies between the paths of helix 96. Even without such a specific lost motion mechanism, drive train backlash is often sufficient to cause such displacement of the extension and retraction helical paths. As mentioned previously, such indexing is provided to enhance cleaning performance and somewhat reduces erosion and wear of the impacted surfaces. However, lost motion indexing does not eliminate these problems since both path positions are fixed resulting in significant areas remaining between these paths which may not have been adequately cleaned. U.S. Pat. No. 4,803,959 provides an indexing system which overcomes this problem by changing the positioning of helical paths 96 and 98 in a predictable manner each time sootblower 10 is actuated.

Figure 5:
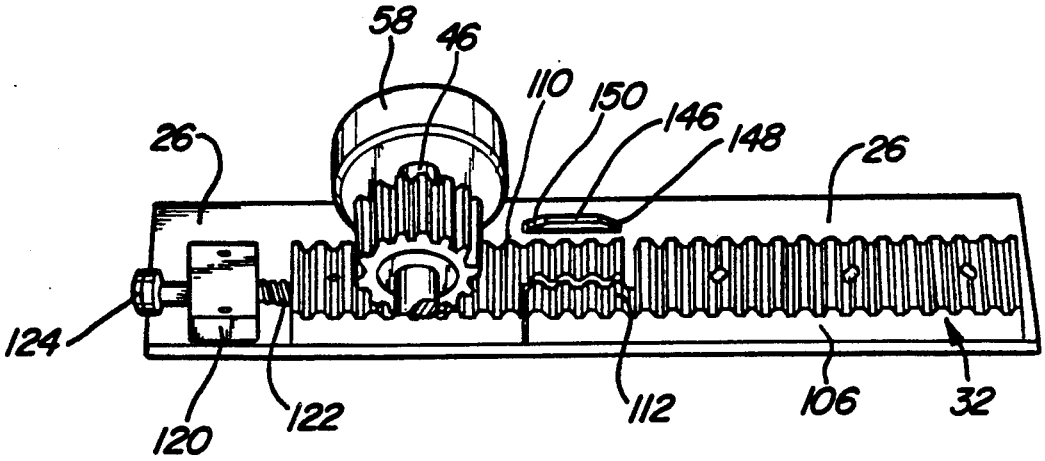
FIG. 5 is an inverted pictorial view of an indexing rack assembly fitted with the brake assembly of the present invention shown with a pinion gear.
Figure 6:
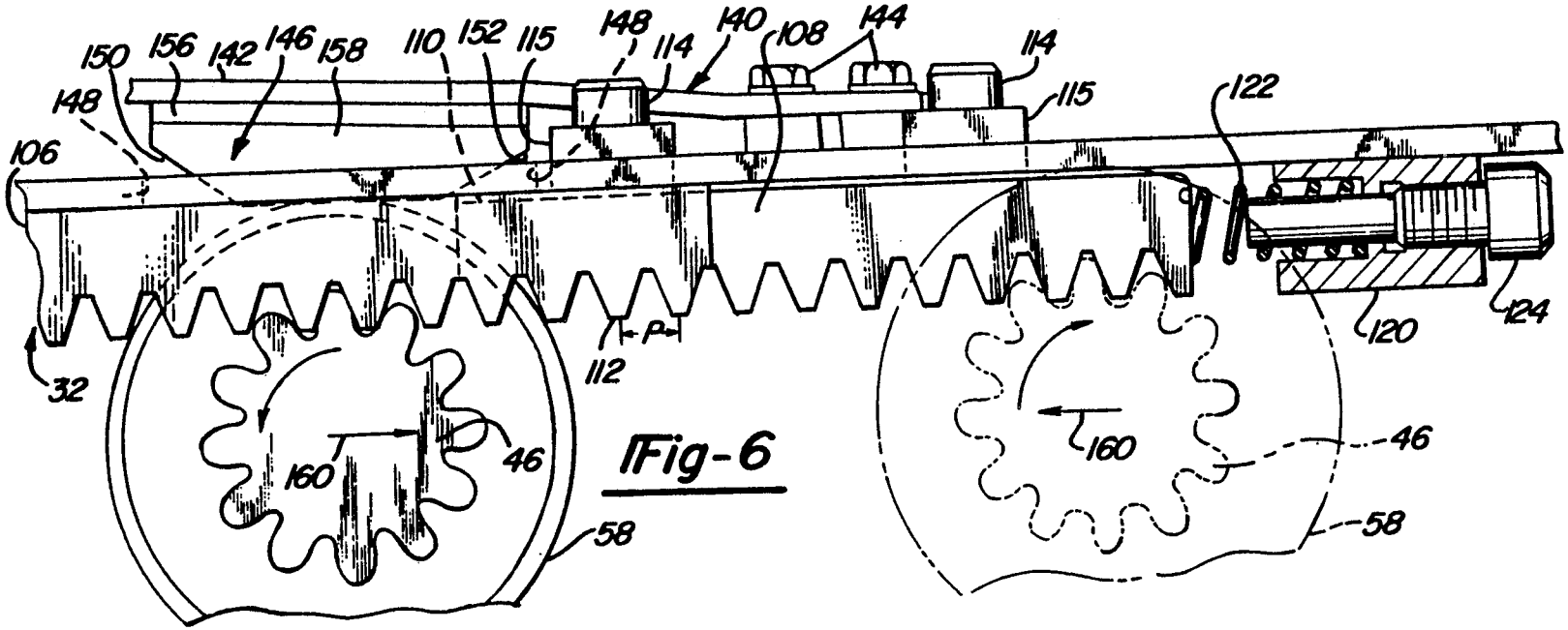
FIG. 6 is a side view of the rack shown in FIG. 5.
Figure 7:
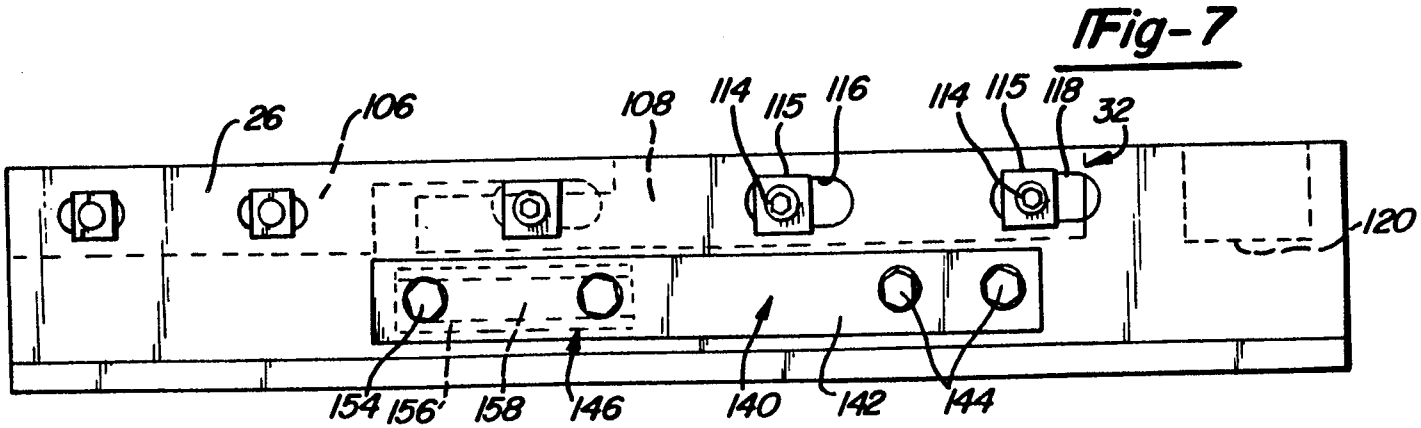
FIG. 7 is a top view of the rack shown in FIG. 5.
Figure 8:
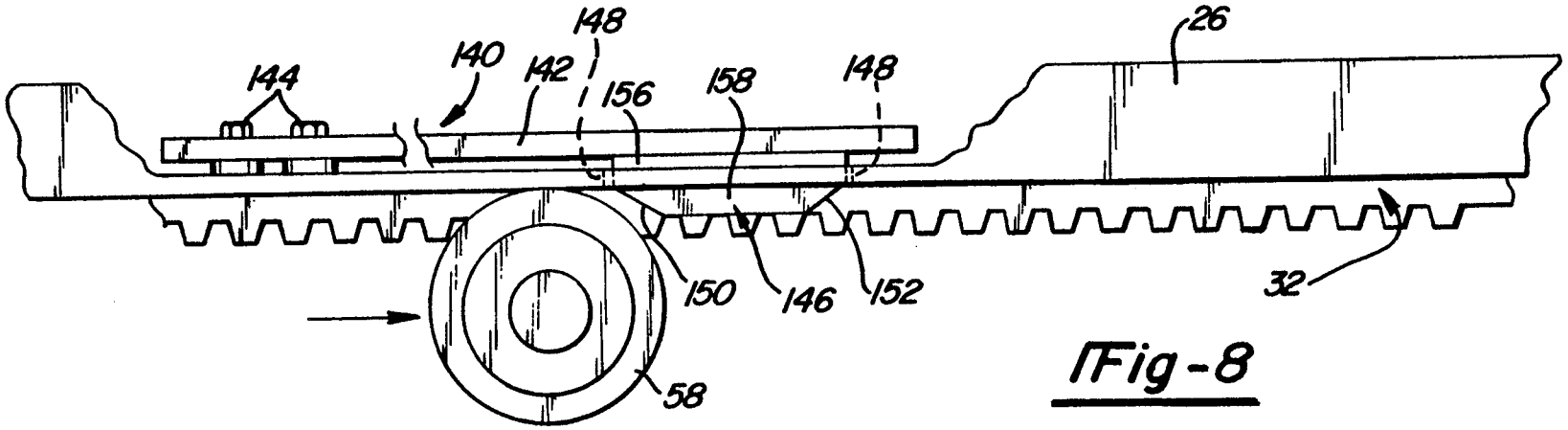
FIG. 8 is an elevational view of the opposing side of the rack shown in FIG. 6.
Figure 9:
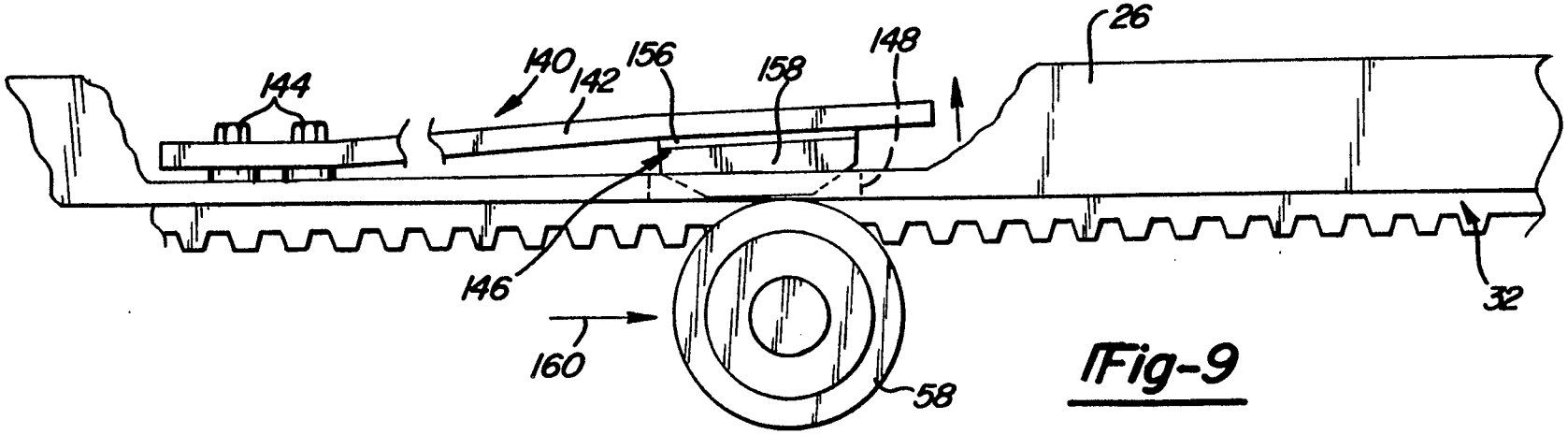
FIG. 9 is a side elevational view similar to that seen in FIG. 8 and further showing the deflection of the present invention's brake assembly.

FIGS. 5 through 7 illustrate rack assembly 32 which incorporates an indexing mechanism in accordance with the above mentioned patent. In order to simplify this description, only rack assembly 32 will be described in detail, it being understood that rack assembly 34, if employed, is identical in configuration and operation. Rack assembly 32 includes a fixed toothed segment 106 and a longitudinally indexible toothed segment 108. Both rack sections 106 and 108 include narrowed ends 110 and 112 which allow them to interfit in overlapping fashion as shown in FIG. 5, while providing engagement for the full width of pinion gear 46. Other means for overlapping the rack segments could be used with equal success such as a dovetail joint or side-by-side racks used with a wide pinion gear. Indexible section 108 is mounted to support rail 26 by threaded fasteners 114 which support slide blocks 115 fitting through longitudinally extending slots 116 and 118. Blocks 115 do not firmly clamp against indexible section 108, thus enabling that section to undergo longitudinal displacements. Spring bracket 120 supports coil spring 122 and adjustable stop screw 124. Coil spring 122 urges indexible section 108 to the position shown in FIGS. 5 and 6, in which sections 110 and 112 completely overlap each other. In this position, the interengagement of the teeth of rack sections 106 and 108 properly mesh with pinion gear 46. As an alternative to the use of spring 122, numerous other compliant devices could be employed such as pneumatic cylinders, etc. Stop screw 124 is adjusted so that longitudinal movement of indexible rack segment 108 toward the right with respect to FIG. 6 is equal to one tooth (pitch) distance, as designated by dimension "P" shown in FIG. 6. Alternately, the indexing motion distance could be a multiple of the pitch spacing. Thus, indexible rack 108 is movable between two extreme positions, both of which provide proper meshing with pinion gear 46.

Rack assemblies 32 and 34 are mounted to rails 26 and 28 such that indexible portion 108 is located furthest from the boiler (although the opposite arrangement could be used). FIG. 6 shows pinion gear 46 in its initial position in phantom lines prior to sootblower actuation. In operation, once drive motor 40 is energized to advance the lance, pinion gear 46 acts on indexible rack segment 108 which accelerates carriage 18 from rest, causing a reaction force which compresses coil spring 122. Once the indexing motion of section 108 is completed, pinion gear 46 advances carriage 18. Once the pinion gear 46 is no longer meshing with indexible segment 108, that rack section is permitted to return to its normal position shown in FIGS. 5 and 6 under the influence of coil spring 122. Once carriage 18 is advanced to fully extend lance tube 14, it reverses its motion to return to the idle position. Upon such reverse motion, pinion gear 46, as shown in full lines in FIG. 6, re-engages with indexible segment 108. Accordingly, each actuation cycle of sootblower 10 causes pinion gears 46 and 48 to advance a fixed amount (e.g. one tooth) with respect to the fixed portion of rack segments 106 and 108. This indexing also causes the positioning of helixes 96 and 98 to be displaced since the longitudinal and rotational lance tube drive mechanisms are geared together and the phasing between pinion gears 46 and 48, and rack assemblies 32 and 34 establish the helix orientations. Such indexing is illustrated by lines 126 in FIG. 2 which are partial tracings of various helixes displaced over a succession of actuation cycles. The total number of unique helical paths for a particular sootblower is a function of the extent of indexing motion in the rack, and the gearing relationships within gear box 42 between the pinion drive shaft and the driven member connected to lance tube 14.

In certain applications, the situation may arise where, upon initial energizing of drive motor 40, pinion gear 46 fails to act on indexible rack segment 108 with a sufficient tractive effort or acceleration to cause indexible rack segment 108 to produce the reaction force which will compress coil spring 122 and allow pinion gear 46 to index relative to fixed rack segment 106. By way of example and not limitation, two situations where the above problem can occur are described below.

The first situation occurs when there is a build up of foreign materials adjacent to indexible rack segment 108 which hinder or prevent the indexing movement of segment 108. The foreign materials may be encrustations resulting from various sources and may include boiler bi-products such as slag or ash.

A second situation where the indexing movement of segment 108 is not produced is a result of lance tube 14 rotation. Upon energizing of drive motor 40, it is seen that lance tube 14 begins to rotate because it is geared to drive motor 40. The rotation of lance tube 40 in conjunction with the inherent friction of the rollers and bearings of support bracket 62 and intermediate support 66 causes carriage 18 to be pulled forward via a "screw" type of action. The screw action is facilitated because the rollers of the supports 62 and 66 are aligned with the helical angle to promote smooth advancement of lance tube 14 during cleaning operations. As a result, carriage 18, along with pinion 64, may be pulled forward prior to the drive load being applied to pinion 64. While the initial forward movement is small, it is of sufficient magnitude to offset the acceleration of pinion 64 necessary to cause the indexing movement of segment 108.

To overcome this lack of initial or sufficient pinion 64 loading, the present invention provides sootblower 10 with a spring loaded brake or friction key assembly 140 which induces the indexing movement of segment 108. In general, brake assembly 140 impedes forward movement of carriage 18 until pinion 64 has been sufficiently loaded to cause the indexing movement of segment 108.

In achieving the above result, brake assembly 140 includes a cantilever leaf spring 142 secured at one end to upper track 26 by threaded fasteners 144. While only one brake assembly 140 is being herein described, it is to be understood that a similar brake assembly 140 may be mounted to track 28. When sootblower 10 is in the retracted position, an engagement block or friction key head 146, which is secured to the opposing free end of leaf spring 142, is biased to pass through a slot 148 formed in track 26. Slot 148 is located in track 26 so that the position of biased engagement or friction key head 146 is in an obstructing relationship with the extension path or line of travel 160 followed by carriage roller 58.

The friction key head 146 is secured to the leaf spring 142 by threaded fasteners 154 or like means. The shape of the friction key head 146 is such that the brake assembly 140 is prevented from being over biased through slot 148 by a horizontal land portion 156 coming into contact with the track 26. Thus, a narrow vertical extension 158 is the portion fully extending through the slot 148.

Upon energizing drive motor 40, carriage 18 moves forward, either by the screw action previously mentioned or by an actual load on pinion 64, until carriage roller 58 engages friction key head 146. As the carriage roller 58 tries to move past the friction key head 146, a force counter to the forward movement will be supplied by assembly 140 through a ramped surface 150 of friction key head 146. The counter force supplied require pinion 64 to develop additional forward tractive effort on segment 108. Movement of carriage 18 is impeded until a sufficient load is supplied to pinion 64 enabling it to deflect both friction key head 146 and leaf spring 142 and to move carriage 18 therepast. A counter force is provided such that carriage roller 58 is restricted from moving past key head 146 until segment 108 has experienced indexing movement and is in contact with stop screw 124 (unless the indexing system cannot index due to failure in which case the carriage roller will move without causing indexing). As such, the counter force can be adjusted as needed by varying the inclination of ramped surface 150 and/or the stiffness of leaf spring 142.

Once carriage roller 58 has moved over and past friction key head 146, the brake assembly 140 assumes its original configuration. On the retraction stroke, carriage roller 58 will engage ramped surface 152, again deflecting leaf spring 142 and friction key head 146. The inclination or slope of ramped surface 152 may differ from that of ramped surface 150. A load sufficient to cause deflection will be readily produced during the retraction stroke since pinion 64 is engaged with fixed segment 106 at that time.

Due to the constantly changing helix positions, repeated blowing medium impact is reduced and, correspondingly, erosion in particular areas of the boiler is lessened. As outlined previously, as a means of increasing the difference in positions between successive helical paths, rack portions 106 and 108 could be modified, or stop screw 124 adjusted to cause indexing motion equal to two or more pitch spacings of the racks. Rack assemblies 32 and 34 are configured to enable them to be used in place of sections of conventional unitary racks presently used in sootblowers. Brake assembly 140 is configured for new installation and for easy retrofitting with rack assemblies 32 and 34 that provide the above indexing capability.

Brake assembly 140, although described in connection with actuating an indexing mechanism, could be used for numerous additional applications. For example, brake assembly 140 could be used for actuating other systems such as limit switches, mechanically actuated fluid control valves etc. Moreover, the motion impeding effect of brake assembly 140 could further be provided simply to control the position of a carriage. Brake assembly 140 could also be positioned at various locations along the sootblower track as the applications dictated.

While the above description constitutes the preferred embodiments of the present invention, it will be appreciated that the invention is susceptible to modification, variation and change without departing from the proper scope and fair meaning of the accompanying claims.

We claim:

1. A brake assembly for impeding longitudinal movement of a sootblower carriage being propelled along a line of travel by a driving force generated by a motor, said brake assembly comprising:

a frame fixed relative to said sootblower carriage;

an engagement block having an engagement surface; and deflectable biasing means secured to said frame for biasing said engagement block into said line of travel of said sootblower carriage, said engagement block being mounted to said biasing means so as to orient said engagement surface for contact with said sootblower carriage, said biasing means coacting with said engagement block and said engagement surface so as to impede longitudinal movement of said sootblower carriage thereby increasing said driving force generated by said motor to an amount wherein said sootblower carriage causes deflection of said engagement block in a direction counter to said biasing means and out of said line of travel thereby allowing said sootblower carriage to continue longitudinal movement along said line of travel.

2. A brake assembly as set forth in claim 1 wherein said biasing means is a spring member having first and second ends, said first end being fixably attached to said frame and said second end having said engagement block mounted thereto.

3. A brake assembly as set forth in claim 2 wherein said spring member is a cantilever spring.

4. A brake assembly as set forth in claim 1 wherein said engagement surface is ramped relative to said line of travel.

5. A sootblower having a lance tube with at least one nozzle for projecting a stream of blowing medium against surfaces within a boiler, said sootblower having a drive train for periodically advancing said lance tube into and out of the boiler and simultaneously rotating said lance tube thereby causing said nozzle to trace a helical path, said drive train having a pinion gear meshing with a toothed rack for driving said lance tube longitudinally, said sootblower comprising:

an indexing mechanism actuated through tractive effort exerted by said pinion upon said rack for longitudinally displacing the helical path traced by said nozzle from one sootblower actuation cycle to another;

brake means for impeding the longitudinal advancement of said lance tube until said pinion exerts sufficient tractive effort upon said rack to activate said indexing mechanism.

6. A sootblower as set forth in claim 5 wherein said brake means acts upon said pinion prior to significant longitudinal advancement of said lance tube into the boiler.

7. A sootblower as set forth in claim 5 wherein said brake means is carried by a fixed support frame coupled to said sootblower.

8. A sootblower as set forth in claim 7 wherein said brake means includes an engagement head and biasing means for biasing said engagement head into a position obstructing the advancement of a carriage of said sootblower, said biasing means so biasing said engagement head until activation of said indexing mechanism and displacement of said helical paths traced by said nozzles, thereafter said biasing means allowing deflection of said engagement head out of said obstructing position thereby permitting the advancement of said sootblower carriage with said nozzle tracing a displaced helical path.

9. A sootblower as set forth in claim 8 wherein said biasing means is a spring member.

10. A sootblower as set forth in claim 9 wherein said spring member is a leaf spring.

11. A sootblower as set forth in claim 8 wherein said spring member is a cantilever spring having one end fixably secured to said support frame and another end secured to said engagement head, said engagement head further having a ramped surface oriented for obstructing the advancement of said sootblower carriage.

12. A brake assembly for a sootblower having a lance tube with at least one nozzle for projecting a stream of blowing medium against surfaces of a boiler, said sootblower also having a frame and a longitudinal toothed rack assembly fixed to said frame, and a carriage including a drive train means for rotating said lance tube and longitudinally moving said carriage along said frame in a synchronized relationship with said lance tube rotation through one or more pinion gears engagable with said toothed rack assembly, said sootblower further having an indexing means actuated by tractive effort exerted by said pinion gear onto said rack for indexing the rotation of said lance tube relative to the longitudinal movement of said carriage along said frame, said brake assembly comprising:

a engagement block secured to a biasing means affixed to said frame for biasing said engagement block into a position obstructing longitudinal movement of said carriage, said biasing means also for coacting with said engagement block to provide a force sufficient to impede longitudinal movement of said carriage thereby requiring said pinion gear to develop sufficient tractive effort to actuate said indexing means.

* * * * *